US009216507B2

(12) United States Patent
Kirchgessner

(10) Patent No.: US 9,216,507 B2
(45) Date of Patent: Dec. 22, 2015

(54) WALL MOUNTED WORK BENCH

(76) Inventor: William A. Kirchgessner, Happy, TX (US)

( * ) Notice: Subject to any disclaimer, the term of this patent is extended or adjusted under 35 U.S.C. 154(b) by 1072 days.

(21) Appl. No.: 13/296,820

(22) Filed: Nov. 15, 2011

(65) Prior Publication Data

US 2012/0119428 A1 May 17, 2012

Related U.S. Application Data

(60) Provisional application No. 61/413,827, filed on Nov. 15, 2010.

(51) Int. Cl.
*B25H 1/02* (2006.01)

(52) U.S. Cl.
CPC ..... *B25H 1/02* (2013.01)

(58) Field of Classification Search
CPC ..... B25B 1/2468; B26D 7/20; A47B 57/567; A47B 63/00; A47B 63/065
See application file for complete search history.

(56) References Cited

U.S. PATENT DOCUMENTS

D295,007 S 4/1988 Hardy et al.
4,819,900 A * 4/1989 Funk ..... A47B 57/44 108/108
5,381,738 A * 1/1995 Meyer ..... A47B 5/00 108/108
5,775,655 A * 7/1998 Schmeets ..... A47B 5/00 108/115
6,039,416 A 3/2000 Lambert
6,113,088 A * 9/2000 Gakhar ..... B25B 5/105 269/139
6,116,163 A * 9/2000 Mitchell ..... A47B 57/20 108/152
7,408,596 B2 * 8/2008 Kunz ..... B60P 3/34 248/286.1
7,604,027 B2 10/2009 Thatcher
7,896,326 B2 * 3/2011 Cunningham ..... A47B 96/061 269/296
8,267,017 B1 * 9/2012 Michael ..... A47B 5/04 108/134
8,529,157 B2 * 9/2013 McKay ..... E02B 3/068 248/242
2009/0127413 A1 * 5/2009 Herron, III ..... A47B 57/42 248/220.21

* cited by examiner

*Primary Examiner* — Lee D Wilson
(74) *Attorney, Agent, or Firm* — Susanne M Moore

(57) ABSTRACT

A wall mounted collapsible work bench, the bench having a frame mounted flush against a wall, at least one support member, and a work surface having a top planar surface, a bottom, a back side, a front side, a first end and an opposing second end, wherein the back side is fixedly hinged to the top bar of the frame such that, in an open position, the work surface hinges upward to rest atop the A shaped braces, perpendicular to the frame and, in a collapsed position, the work surface hinges downward to lie parallel to the frame.

16 Claims, 9 Drawing Sheets

WALL MOUNTED WORK BENCH

CROSS REFERENCE TO RELATED APPLICATIONS

This application claims the benefit of provisional application 61/413,827 filed Nov. 15, 2010 by the same inventor and the same is incorporated in its entirety herein.

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING

Not Applicable

DESCRIPTION OF ATTACHED APPENDIX

Not Applicable

BACKGROUND OF THE INVENTION

1. Field of the Invention

The disclosed invention relates to work tables and work benches and, more specifically, a novel wall mounted collapsible work bench that further may incorporate expansion points and accessory brackets.

2. Description of Related Art

The prior art is replete with various types of work tables and work benches, some of which include various folding or retraction components in order to save space. For example, U.S. Pat. No. 6,039,416 describes a space saving, pivotal work bench assembly comprising a fixed tool storage housing mounted on a wall. U.S. Pat. No. 7,604,027 describes a retractable workbench that is mounted to a vertical surface such as a wall. D295,007 is a design patent showing a design for a wall-mounted foldable work bench.

These patents describe bench designs that save work space, yet each has certain unsolved problems. For instance, a wall mounted work bench needs to be quick and easy to fold out for set up (even for one person) and similarly easy to fold away. For practicality, it needs to be capable of holding a large amount of weight, such as a heavy motor or table saw. It should have the capacity to, as needed, expand to accommodate long pieces of wood, pipe or other materials, longer than the longitudinal surface of one workbench, in order to accommodate large projects. It should easily collapse into a storage position that requires little or no floor space. During use, it should effectively house necessary tools, clamps, or other accessories in such a way that they are easy to reach for and use. To date there is no disclosed work bench that solves all of these issues.

NOTATION AND NOMENCLATURE

Certain terms are used throughout the following description to refer to particular method components. As one skilled in the art will appreciate, design and manufacturing companies may refer to a component by different names. This document does not intend to distinguish between components that differ in name but not function.

In the following discussion, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other intermediate devices and connections. Moreover, the term "method" means "one or more components" combined together. Thus, a method can comprise an "entire method" or "sub methods" within the method.

SUMMARY OF THE INVENTION

The disadvantages shown in the prior art are solved by a method and device for a wall mounted work bench that can be set up by one person in only a few seconds and can similarly be collapsed into the storage position by one person in only a few seconds. The disadvantages shown in the prior art are further solved by the disclosed method and device incorporating a novel system for fast and easy expansion and for placement of tools and other objects. Despite the various patents and devices described, there is no known prior art describing a quick release type collapsible work bench that requires no floor space when in the collapsed position and that further provides expansion points and place holders.

It is an objective of the disclosed method and device to provide a work surface that, when not in use, can be quick release collapsed easily by one person.

It is an objective of the disclosed method and device to provide a work surface that can be collapsed to rest parallel against the wall when not in use, freeing up floor space for other purposes.

It is an objective of the disclosed method and device to provide a workbench having expansion brackets to increase versatility, depending on the needs of the project.

It is an objective of the disclosed method and device to provide a collapsible quick release workbench that is capable of supporting heavy objects, such a motor or table saw.

It is an objective of the disclosed method and device to enable a user to support, and manipulate large pieces of construction materials, using very little or no floor space.

It is an objective of the disclosed method and device to enable the possible engagement of the simultaneous work surface use of two or more close in proximity workbenches at a time.

It is an objective of the disclosed method and device to provide a quick release collapsible workbench having hollow brackets on the surface plane, into which interchangeable support members can be inserted to accommodate tools, the bench itself or connecting rods.

BRIEF DESCRIPTION OF THE DRAWINGS

The drawings contained herein represent preferred embodiments of the invention and are not intended to limit the scope. For a detailed description of various embodiments, reference will now be made to the accompanying illustrative drawings in which.

DETAILED DESCRIPTION

In an embodiment, the disclosed method and device comprises a quick release collapsible wall mount work bench having a wall mounted frame, a support member and a work surface. The work surface when in use is raised to sit perpendicular to the wall, supported by the support member. When not in use, the support member is collapsed and the work surface easily hinges down out of the way to lie parallel to the wall. If desired the free bottom side of the bench may be latched in place when in the storage position.

The workbench and components are made from any rigid materials capable of serving the functions disclosed herein and may include, but are not limited to, metal, steel, sheet metal, iron, rigid plastic, wood or other materials, provided they are rigid, strong and supportive enough to meet the desired objectives described herein.

In an embodiment the workbench may further comprise a perimeter lip extending perpendicularly to the plane of the upper surface on any or all of the sides or ends in order to prevent tools or other objects from falling or sliding off the work surface.

In the preferred embodiment, as a matter of practice, the user will generally keep the work bench in the collapsed position (work surface hinged downward to lie parallel against the frame and the wall) when not in use, freeing up the floor space for other uses. In this position, the work bench will protrude only a few inches from the wall surface and consequently take up only a small amount of wall space in the garage, workshop, warehouse or other place of use and will take up no floor space.

In the described construction, when the work bench is in the open position and in use it is strong enough to hold several hundred pounds.

Figure 1:
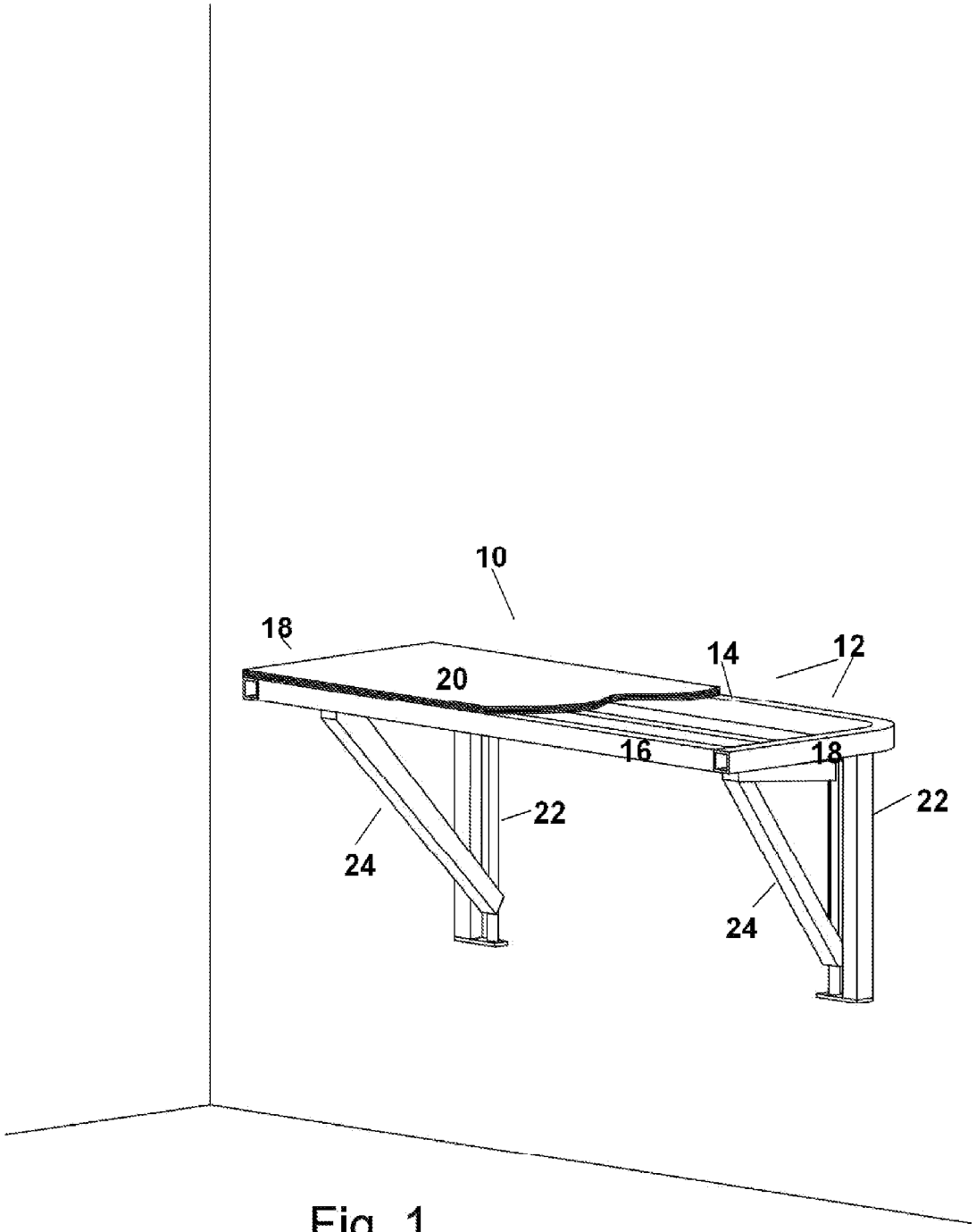
FIG. 1 depicts a front perspective view of the disclosed invention in the open position and in accordance with an embodiment.

Turning to the figures, FIG. 1 is a front perspective view of an embodiment of the disclosed invention revealing the workbench 10 in the open extended position and ready for use. In this embodiment the work bench 10 is a heavy duty frame constructed of steel, metal or iron tubing. The work bench has a 12 having a fixed side 14, an opposing free side 16 and two opposing ends 18. Atop the metal frame 12 is a solid planar surface 20 of the bench 10. In the illustration, the solid surface top 20 is shown partially across the metal frame 12, and is shown in a cutaway view at one end to reveal the metal frame 12 below. Below the top metal frame 12 are two wall braces 22 mounted to the wall which support the fixed side 14 of the bench and are further mounted thereto. Mounted to the free side of the metal frame 12, on opposing corners, are support legs 24 having a top end and a bottom end, the top end locking into place under the surface top and the bottom end locking into place on the wall brace when the bench 10 is fully extended.

Figure 2:
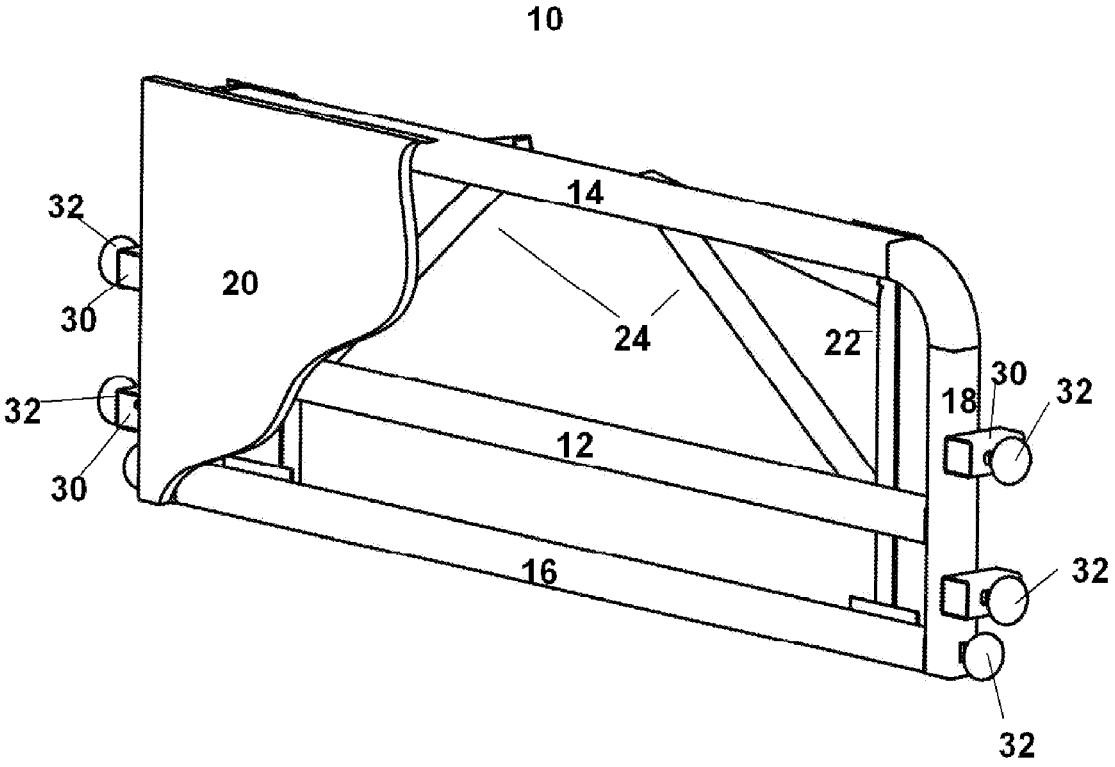
FIG. 2 depicts a front perspective view of the disclosed invention in the collapsed position and in accordance with an embodiment.

In FIG. 2 the workbench 10 is shown in the folded up storage position lying horizontally against and parallel to the wall. It is clear from the illustration that the folded up workbench has a slim profile against the wall and uses no floor space, allowing versatility of use for the garage, workshop, or other similar environment. Visible at each end are expansion channel brackets 30 created by the use of square tubing (although other shapes could be used) into which connecting rods or accessory tools may be inserted serving to expand the size of the workbench 10 such that large pieces of wood or other materials may extend across the top of the bench, or so that multiple work benches can be joined together to create a larger workspace. Once a connecting rod or accessory tool, such as a clamp, is placed into this bracket 30 the device may be tightened into place by the user turning the pictured knob 32 which progresses a bolt through the bracket, holding it tight against the tool.

Figure 3:
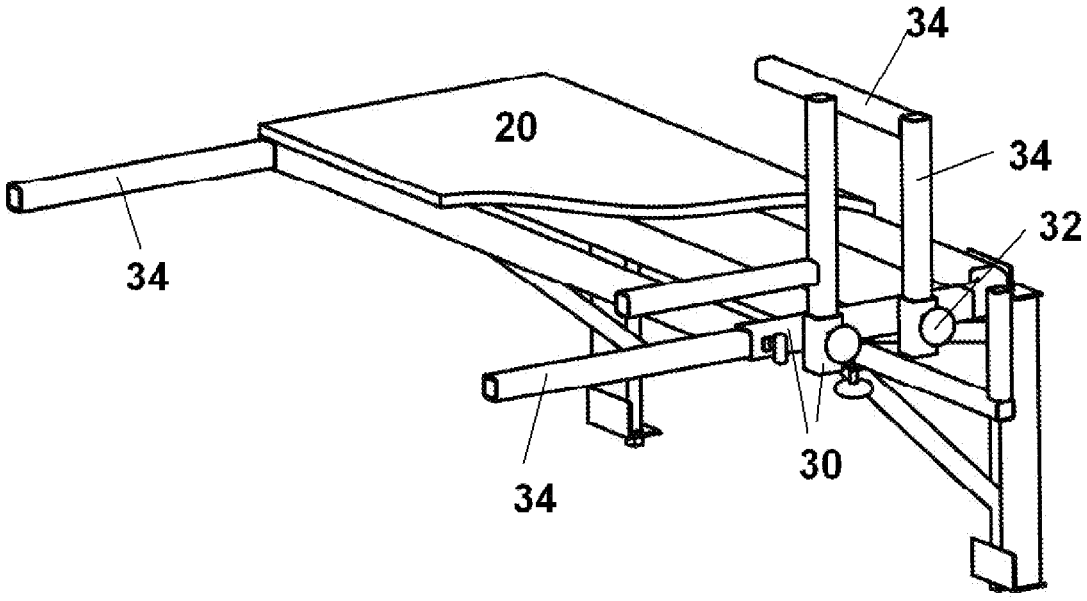
FIG. 3 depicts a front perspective view of the disclosed invention in the open position showing expansion and accessory brackets in accordance with an embodiment.

FIG. 3 depicts a more detailed view of the brackets 30 indicating how various connecting rods 34 and accessories may be inserted into the brackets 30 which are then tightened into place by the knob 32 or dial 32. These rods 34 and accessories may be of varying lengths in order to provide more versatility of use in the work bench, as they increase the potential workspace and also serve as tool accessory holders.

Figure 4:
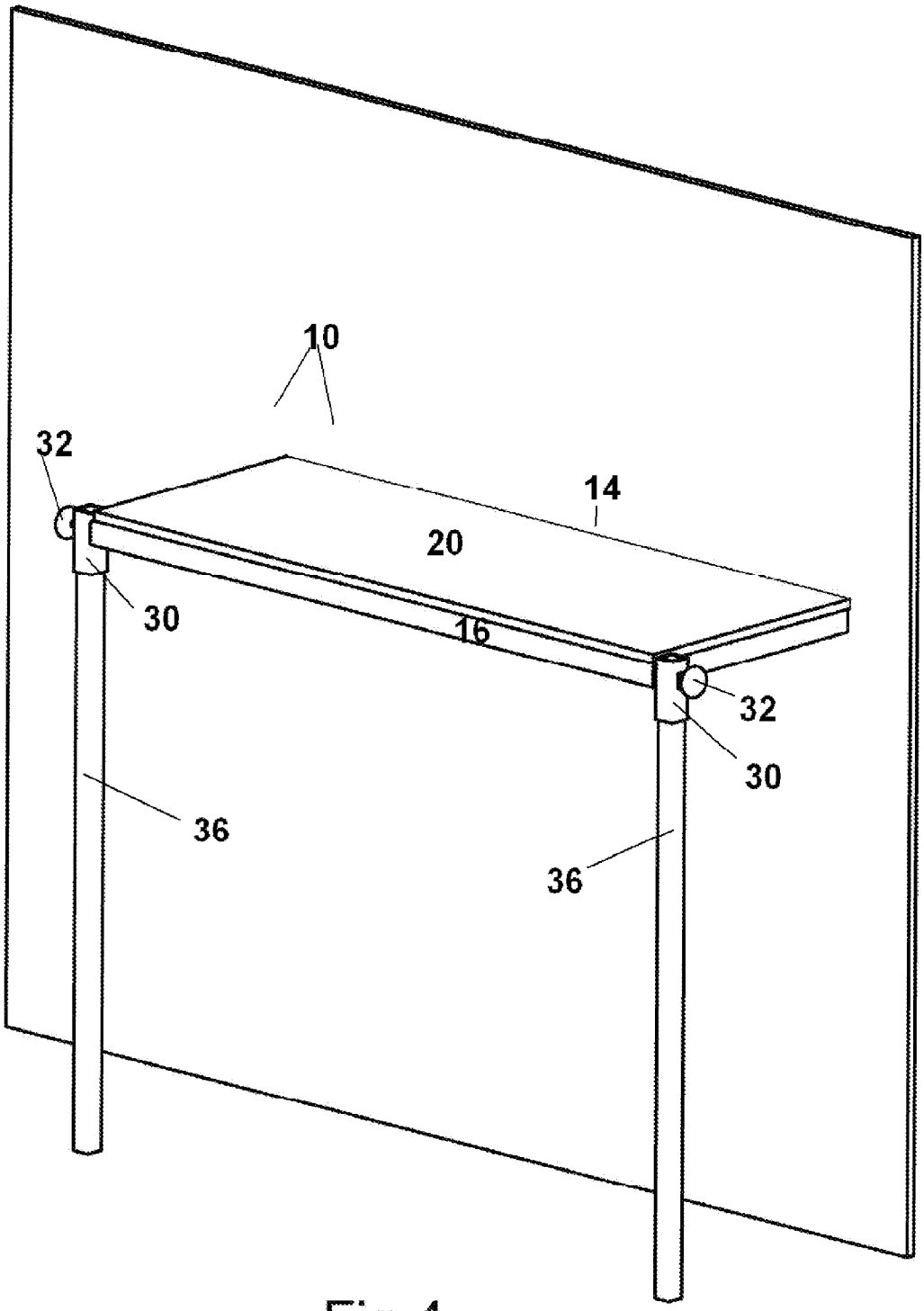
FIG. 4 depicts a front view of the disclosed invention showing an alternative embodiment having freestanding legs.

FIG. 4 depicts an alternate embodiment wherein the support members are legs 36 having a top end and a bottom end, the top end inserting into the bottom of the expansion channel bracket 30 and the bottom end resting on the floor or ground, in order to support the work surface. The upper planar surface 20 of the work bench may be smooth or may, in alternative embodiments, have holes, grating or perforations in order to more rigidly support and stabilize objects placed on the surface. Similarly the surface may be made of, or coated with, a conductive or non-conductive material. A variegated surface may be contemplated to provide surface friction such that the objects utilized on the surface do not move around. A drain may be added to add more versatility of use.

An advantage of the design shown herein is that the connecting rods are interchangeable with all of the channel brackets, enabling a user who has multiple workbenches in an area to connect the benches and create additional workspace in quite a number of ways.

Figure 5:
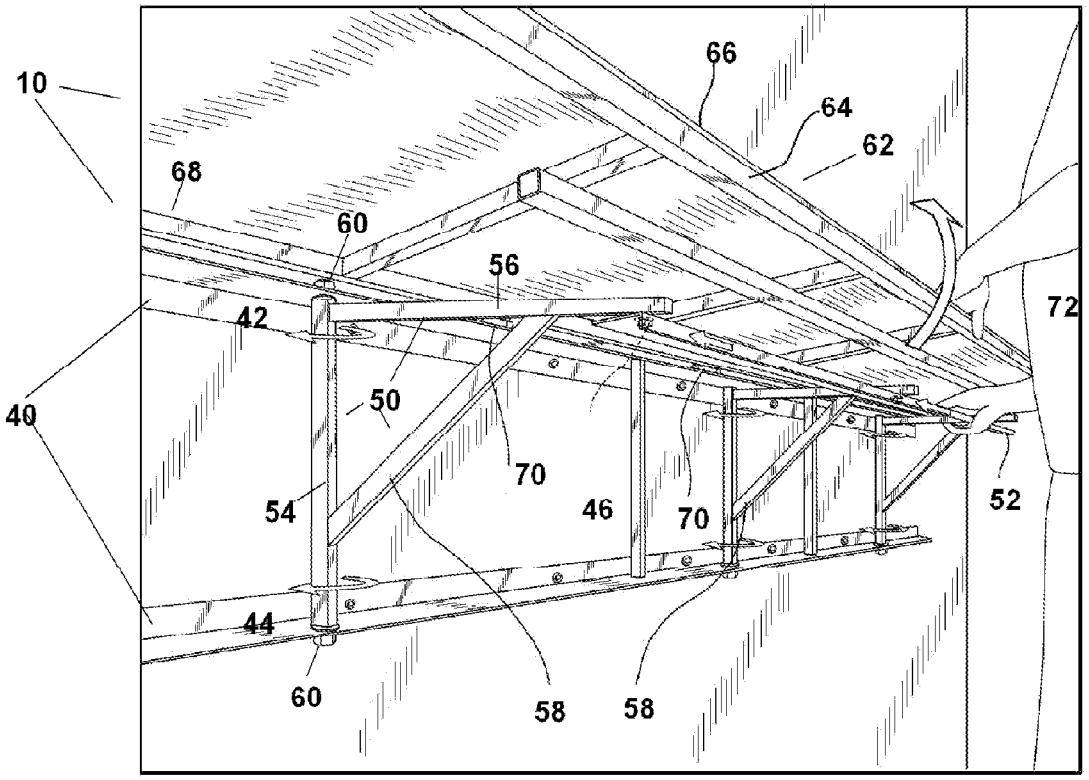
FIG. 5 depicts a view from underneath looking up at the disclosed work bench in accordance with the preferred embodiment and showing the support member being pivoted outward to the open position.

Turning to FIG. 5, the preferred embodiment of the disclosed work bench is depicted. In this embodiment, the work surface is supported by a novel and more advanced pivoting support member that enables a quick release collapse and set up.

In FIG. 5 the work bench 10 is depicted being set up by the user. The work bench 10 comprises three components, the first being a rectangular wall frame 40 made of metal bars, bolted flush against the wall. In the preferred embodiment angle irons are used although other types of bars may be used. In FIG. 5 the disclosed rectangular work frame is comprised of a horizontal top angle iron 42, a horizontal bottom angle iron 44, a vertical end angle iron 46, an opposing vertical end angle iron 46 and, as needed one or more vertical angle iron supports 46 connecting the top 42 and bottom 44 angle irons.

The second component is a support member which comprises at least two A shaped braces 50 connected by a horizontal linkage bar 52. Each A shaped brace 50 is comprised of a first leg 54 communicating from the top angle iron 42 to the bottom angle iron 44, a second leg 56 communicating from the top of the first leg 54 to the horizontal linkage bar 52, and a third leg 58 communicating from the inside of the first leg 54 to the inside of the second leg 56. The top of the first leg is affixed to the top angle iron by means of a swiveling bolt 60. The bottom of the first leg 54 is affixed to the bottom angle iron 44 by means of a swiveling bolt 60. The swiveling bolts 60 enable each entire A shaped brace 50 to swivel and rotate to at least a 90 degree radius.

The horizontal linkage bar 52 connects the A shaped braces 50 together such that when the user grasps the bar 52 and pulls on it, the A shaped braces 50 rotate, enabling the braces 50 to, by a pull of the bar 52, be rotated outward into a locked and open position perpendicular to the wall or, by an opposite pull of the bar 52, to be rotated inward into a collapsed position parallel to the wall.

The third component of the work bench in its preferred embodiment as disclosed in FIG. 5 is the work surface 62 which comprises a frame 64 having as its top a planar surface area 66 on which to work. In the preferred embodiment, the frame is rectangular and is constructed primarily of square tubing, the square tubing being conducive to forming the channel brackets described in the earlier figures and which are incorporated into this embodiment as well. The rectangular frame has a top, a bottom, a front side, a back side, a first end and an opposing second end. The back side 68 is fixedly mounted to the top angle iron 42 of the wall frame, preferably by hinges 70 which enable an upward and downward pivot action. The front side is free and is perpendicular to the wall when the work bench is in the open (in use) position or parallel to the wall when the work bench is in the collapsed (storage) position.

FIG. 5 depicts the user 72 lifting the hinged work surface 62 upward and then pulling the horizontal linkage bar 52 to the left, which deploys the A shaped braces 50 into the open position, perpendicular to the wall. The work surface 62 is then lowered to rest atop the A shaped braces 50.

Figure 6:
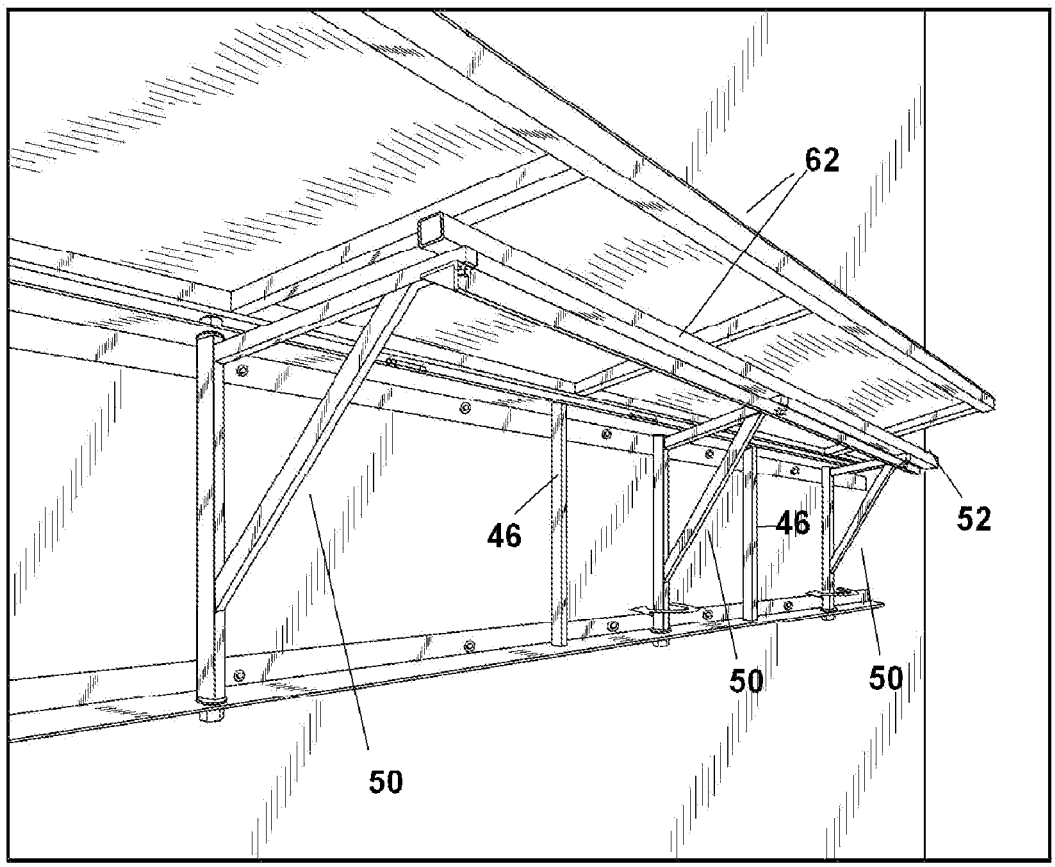
FIG. 6 depicts a view from underneath looking up at the disclosed work bench in accordance with the preferred embodiment and showing the bench fully open and set up.

FIG. 6 shows the table fully open with the A shaped braces 50 fully deployed to the ninety degree angle to the wall position and the work surface 62 resting atop the braces 50 by gravity.

Figure 7:
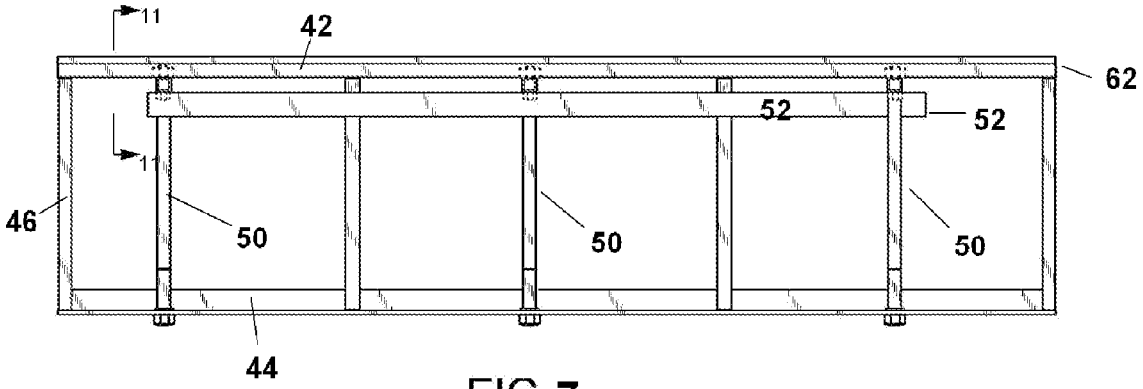
FIG. 7 depicts a front view of the disclosed work bench fully open and set up in accordance with the preferred embodiment.

FIG. 7 is a front view where the work bench is in the open position with the work surface 62 at a ninety degree angle to the wall and resting atop the fully deployed A shaped braces 50.

Figure 8:
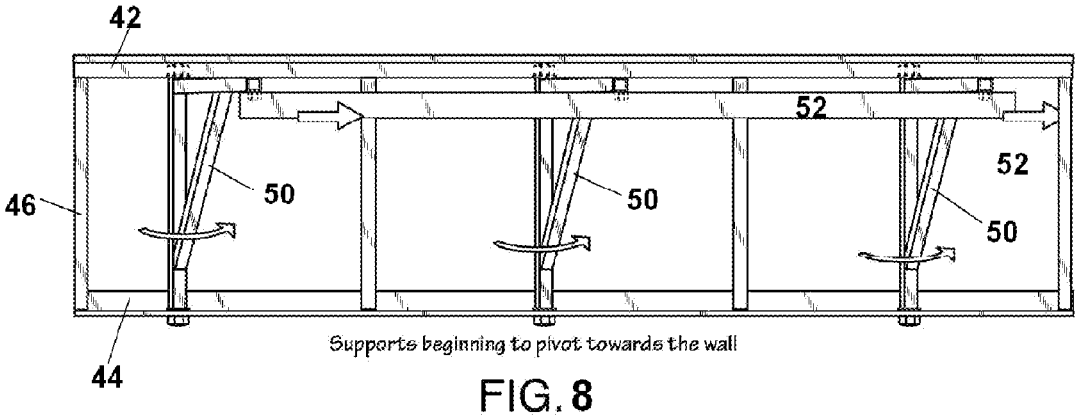
FIG. 8 depicts a front view of the work bench in accordance with the preferred embodiment and showing the support member beginning to pivot towards the wall in the quick release collapse process.

FIG. 8 is a front view revealing the mechanism of action of the A shaped braces 50 beginning to pivot towards the wall as the user pulls the horizontal linkage bar 52 to the right in order to begin collapsing the work bench.

Figure 9:
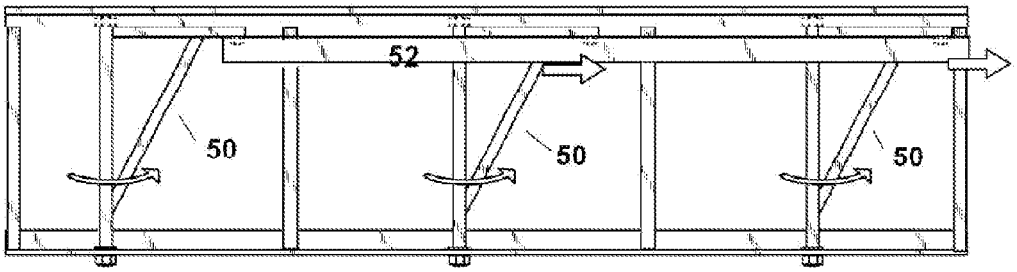
FIG. 9 depicts a front view of the work bench in accordance with the preferred embodiment and showing the support member becoming fully folded against the wall.

FIG. 9 is a front view revealing the horizontal linkage bar 52 pulled all the way to the right and the A shaped braces 50 resting nearly flush to and parallel against the wall as the work bench 10 is being collapsed.

Figure 10:
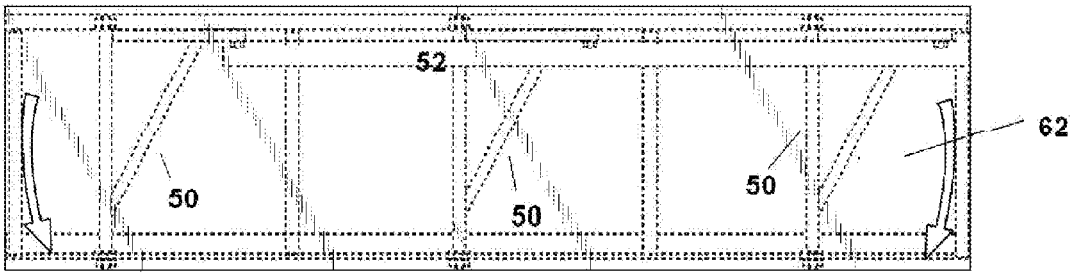
FIG. 10 depicts a front view of the work bench fully collapsed with the work surface rotated down to lie against and parallel to the wall frame, in accordance with the preferred embodiment.

FIG. 10 is a front view revealing the closed position of the work bench 10 with the work surface 62 rotated down against the wall and the support member comprising the A shaped braces 50 and the horizontal linkage bar 52 shown underneath in phantom.

Figure 11:
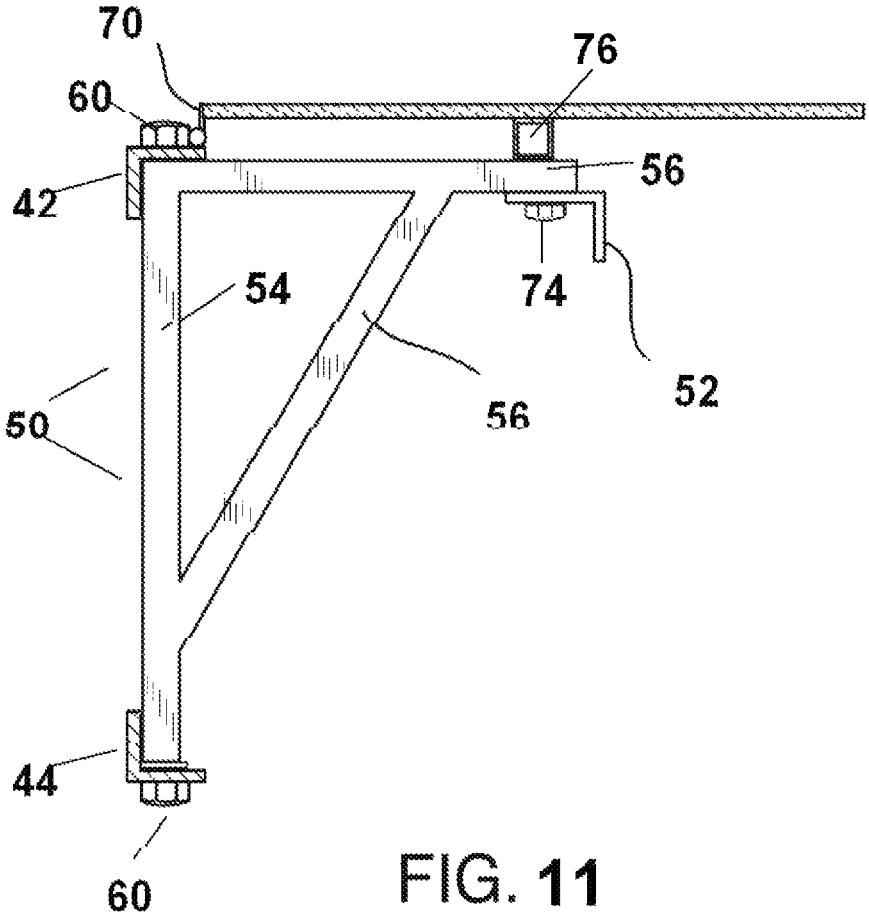
FIG. 11 depicts a close up cross section of the A shaped brace in accordance with the preferred embodiment.

FIG. 11 is a cross section of FIG. 6 showing a side close up view of the A shaped brace 50 as mounted to the work bench. Visible is the top angle iron 42 and the bottom angle iron 44 of the wall frame, the hinge 70 fixedly mounting the work surface 62 to the wall frame 40 and both the planar surface 66 and the frame 64 of the work surface. Also visible are the swivel bolts 60 at the top and the bottom of the first leg of the A shaped brace, as well as a bolt 74 fixedly connecting the second leg 56 of the A shaped brace 50 to the horizontal linkage bar 52. The square tubing construction of the work surface is seen into the ends of which can be inserted the bracket 30 as seen and described in FIG. 3.

The disclosed method and apparatus offers novel solutions to the problems currently encountered with known workbenches and tables. The same disclosed embodiments of this method and system can be applied to a variety of similar work station devices and are not limited to workbenches, for example, can be applied to a welding cart, a wall stand, a jack stand and other types of work stations.

Although the work bench described in the preferred embodiment is constructed partially of angle irons it may be constructed of other suitable materials achieving the same objectives described herein.

While the disclosed method and apparatus has been described in conjunction with the preferred embodiments thereof, many changes, modifications, alterations and variations will be apparent to those skilled in the art. The invention should therefore not be limited to the particular preferred embodiment disclosed but should include all embodiments that could fall within the scope of the claims.

Accordingly, the preferred embodiments of the invention shown in the drawings and described in detail above are intended to be illustrative, not limiting, and various changes may be made without departing from the spirit and scope of the invention as defined by the claims set forth below.

What is claimed is:

1. A wall mounted collapsible work bench, the bench comprising:

a frame constructed of a horizontal top bar, a horizontal bottom bar, and at least one vertical bar connecting the top and bottom bars, the frame mounted flush against a wall;

at least one support member comprising at least two A shaped braces connected together by a horizontal linkage bar, each A shaped brace having a first leg communicating from the top bar to the bottom bar, a second leg communicating from the first leg to the horizontal linkage bar and a third leg communicating from the first leg to the second leg, the first leg affixed to the top bar by a swiveling bolt and affixed to the bottom bar by a swiveling bolt such that the support member can pivot from an open position perpendicular to the frame to a closed position parallel with the frame;

a work surface having a top planar surface, a bottom, a back side, a front side, a first end and an opposing second end, wherein the back side is fixedly hinged to the top bar of the frame such that, in an open position, the work surface hinges upward to rest atop the A shaped braces, perpendicular to the frame and, in a collapsed position, the work surface hinges downward to lie parallel to the frame.

2. The work bench of claim 1 wherein each bar comprising the frame is constructed of a material selected from the group consisting of iron, steel, metal, angle iron.

3. The work bench of claim 1 wherein the work surface is constructed primarily of tubing.

4. The work bench of claim 1 further comprising at least one channel bracket for inserting expansion tubing.

5. The work bench of claim 1 further comprising at least one channel bracket for inserting an accessory.

6. A wall mounted collapsible work bench, the bench comprising:

a frame constructed of a horizontal top bar, a horizontal bottom bar, and at least one vertical bar connecting the top and bottom bars, the frame mounted flush against a wall;

a work surface having a top planar surface, a back side, a front side, a first end and a second opposing end, the back side being perpendicularly hinged to the top bar of the frame such that, in an open position, the work surface is perpendicular to the wall mounted frame and, in a closed position the work surface hinges downward parallel to the frame;

at least one support member for supporting the work surface when in an open position.

7. The work bench of claim 6 wherein the at least one support member comprises one or more legs, each leg having a top end that is in removable communication with the work surface and a bottom end that is resting on the floor.

8. The work bench of claim 6 wherein the at least one support member comprises at least two A shaped braces connected together by a horizontal linkage bar, each A shaped brace having a first leg communicating from the top bar to the bottom bar, a second leg communicating from the first leg to the horizontal linkage bar and a third leg communicating from the first leg to the second leg, the first leg affixed to the top bar by a swiveling bolt and affixed to the bottom bar by a swiveling bolt such that the support member can pivot from an open position perpendicular to the frame to a closed position parallel with the frame.

9. The work bench of claim 6 wherein the work surface is constructed primarily of tubing.

10. The work bench of claim 6 further comprising at least one channel bracket for inserting expansion tubing.

11. The work bench of claim 6 further comprising at least one channel bracket for inserting an accessory.

12. A method of constructing a collapsible work bench that saves floor space, the method comprising:

constructing a frame comprising a horizontal top bar, a horizontal bottom bar, and at least one vertical bar connecting the top and bottom bars;

mounting the frame flush against a wall;

constructing at least one support member comprising a plurality of A shaped braces connected together by a stabilizing rod, each A shaped brace having a first leg communicating from the top bar to the bottom bar, a second leg communicating from the first leg to the horizontal linkage bar and a third leg communicating from the first leg to the second leg, the first leg affixed to the top bar by a swiveling bolt and affixed to the bottom bar by a swiveling bolt such that the support member can pivot from an open position perpendicular to the frame to a closed position parallel with the frame;

constructing a work surface having a top planar surface, a bottom, a back side, a front side, a first end and an opposing second end, wherein the back side is fixedly hinged to the top bar of the frame such that, in an open position, the work surface hinges upward to rest atop the A shaped braces, perpendicular to the frame and, in a collapsed position, the work surface hinges downward to lie parallel to the frame.

13. The method of claim 12 wherein when constructing the frame the bars are constructed of angle irons.

14. The method of claim 12 wherein when constructing the work surface it is constructed of tubing.

15. The method of claim 12 wherein when constructing the work surface, there is further constructed at least one channel bracket for inserting expansion tubing.

16. The method of claim 12 wherein when constructing the work surface, there is further constructed at least one channel bracket for inserting an accessory.

* * * * *